US011707818B2

(12) United States Patent
Li et al.

(10) Patent No.: US 11,707,818 B2
(45) Date of Patent: Jul. 25, 2023

(54) TWO-PIECE HAMMER FOR IMPACT TOOL

(71) Applicant: MILWAUKEE ELECTRIC TOOL CORPORATION, Brookfield, WI (US)

(72) Inventors: Yan Qiang Li, Dongguan (CN); Kevin K. Taylor, Grafton, WI (US); Leonard F. Mikat-Stevens, Milwaukee, WI (US); Connor M. Temme, Medford, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/052,466

(22) PCT Filed: Sep. 17, 2020

(86) PCT No.: PCT/US2020/051166
§ 371 (c)(1),
(2) Date: Nov. 2, 2020

(87) PCT Pub. No.: WO2021/055535
PCT Pub. Date: Mar. 25, 2021

(65) Prior Publication Data

US 2021/0362308 A1 Nov. 25, 2021

(30) Foreign Application Priority Data

Sep. 20, 2019 (CN) ..... 201921581499.4

(51) Int. Cl.
*B25B 21/02* (2006.01)
*B25B 23/145* (2006.01)
(Continued)

(52) U.S. Cl.
CPC ..... *B25B 21/026* (2013.01); *B25D 11/02* (2013.01); *B25D 11/04* (2013.01); *B25D 11/10* (2013.01); *B25D 17/06* (2013.01)

(58) Field of Classification Search
CPC ..... B25B 21/026; B25D 11/02; B25D 11/04; B25D 11/10; B25D 17/06
(Continued)

(56) References Cited

U.S. PATENT DOCUMENTS 2,160,150 A * 5/1939 Jimerson ..... B25B 21/026 173/93.6
2,562,543 A * 7/1951 Gippert ..... C22C 38/12 420/99
(Continued)

FOREIGN PATENT DOCUMENTS

CN 104044117 A 9/2014
FR 1095044 A * 12/1954
(Continued)

OTHER PUBLICATIONS

Interalloy, "1045MediumTensileCarbonSteelBarFactSheet", Sep. 12, 2011 (Year: 2011).*
(Continued)

*Primary Examiner* — Thomas M Wittenschlaeger
*Assistant Examiner* — David G Shutty
(74) *Attorney, Agent, or Firm* — Michael Best & Friedrich LLP

(57) ABSTRACT

An impact tool and a hammer. The impact tool includes a housing, a motor supported within the housing, an anvil extending from the housing, and a drive assembly configured to convert a continuous rotational input from the motor to intermittent applications of torque to the anvil. The drive assembly includes a camshaft driven by the motor and a hammer configured to reciprocate along the camshaft. The hammer includes a core coupled to the camshaft and a sleeve coupled to the core.

19 Claims, 9 Drawing Sheets

(51) Int. Cl.
*B25D 11/02* (2006.01)
*B25D 11/04* (2006.01)
*B25D 11/10* (2006.01)
*B25D 17/06* (2006.01)

(58) Field of Classification Search
USPC ..... 173/90
See application file for complete search history.

(56) References Cited

U.S. PATENT DOCUMENTS 2,564,224 A * 8/1951 Mitchell ..... F16D 43/06 81/466
3,759,334 A 9/1973 Theurer
3,807,804 A * 4/1974 Kniff ..... B25D 17/02 299/113
3,820,848 A * 6/1974 Kniff ..... E21C 35/197 384/222
4,313,505 A * 2/1982 Silvern ..... B25B 21/026 173/93.5
4,609,053 A 9/1986 Ragnmark
4,725,098 A * 2/1988 Beach ..... E21C 35/183 299/105
6,491,111 B1 12/2002 Livingston et al.
6,592,597 B2 7/2003 Grant et al.
6,725,945 B2 4/2004 Sugimoto et al.
6,932,172 B2 * 8/2005 Dvorachek ..... E21C 35/183 175/379
7,101,128 B2 * 9/2006 Hansson ..... B23B 29/046 408/239 R
7,124,839 B2 10/2006 Furuta et al.
7,131,503 B2 11/2006 Furuta et al.
7,308,948 B2 * 12/2007 Furuta ..... B25B 21/023 173/48
7,380,612 B2 6/2008 Furuta
7,380,613 B2 6/2008 Furuta
7,416,031 B2 8/2008 Murakami et al.
7,438,140 B2 * 10/2008 Sterling ..... B25B 21/02 173/104
7,669,938 B2 * 3/2010 Hall ..... E21C 35/183 299/113
7,918,286 B2 4/2011 Nagasaka et al.
8,047,057 B2 * 11/2011 Chen ..... B25F 5/001 173/217
8,069,929 B2 12/2011 Sugimoto et al.
8,490,714 B2 * 7/2013 Nakamura ..... B25B 21/00 173/93.5
8,631,880 B2 1/2014 Murthy et al.
9,114,514 B2 8/2015 Leong et al.
9,120,243 B2 * 9/2015 Tutschek ..... E21C 35/183
9,205,547 B2 * 12/2015 Hirabayashi ..... B25B 21/02
9,314,908 B2 4/2016 Tanimoto et al.
9,616,558 B2 4/2017 Nishikawa et al.
9,925,653 B2 3/2018 Staas et al.
9,975,224 B2 * 5/2018 Tanaka ..... B25B 21/02
10,016,881 B2 * 7/2018 Aoyagi ..... B25B 21/02
10,786,888 B2 * 9/2020 Chung ..... B25F 5/001
2001/0010268 A1 8/2001 Tokunaga et al.
2005/0199404 A1 9/2005 Furuta et al.
2006/0090913 A1 5/2006 Furuta
2007/0000675 A1 1/2007 Sell et al.
2007/0024013 A1 * 2/2007 Hauptmann ..... B25D 17/24 279/75
2010/0000749 A1 * 1/2010 Andel ..... B25B 21/026 173/202
2010/0000750 A1 * 1/2010 Andel ..... B25B 21/026 173/217
2010/0025063 A1 2/2010 Kuhnapfel et al.
2010/0071923 A1 * 3/2010 Rudolph ..... B25D 16/006 173/48
2010/0319945 A1 12/2010 Chen
2010/0326686 A1 12/2010 Leong et al.
2011/0120739 A1 5/2011 Chen
2012/0111592 A1 5/2012 Limberg et al.
2012/0152577 A1 * 6/2012 Mattson ..... B25D 17/02 81/436
2012/0234566 A1 9/2012 Mashiko et al.
2012/0292065 A1 11/2012 Hoshi et al.
2012/0318548 A1 * 12/2012 Hirabayashi ..... B25B 21/00 173/93.6
2013/0087355 A1 4/2013 Oomori et al.
2013/0112448 A1 5/2013 Profunser et al.
2013/0133911 A1 5/2013 Ishikawa et al.
2013/0161044 A1 6/2013 Hecht et al.
2013/0264087 A1 10/2013 Harada et al.
2013/0333910 A1 12/2013 Tanimoto et al.
2014/0008089 A1 1/2014 Yeoh et al.
2014/0124229 A1 5/2014 Takahashi et al.
2014/0158388 A1 * 6/2014 Johnson ..... B25B 21/02 173/1
2014/0262396 A1 * 9/2014 McClung ..... B25B 21/02 173/93
2014/0338945 A1 11/2014 Herr et al.
2014/0367132 A1 12/2014 Tanaka et al.
2015/0014009 A1 1/2015 Staas et al.
2015/0041169 A1 2/2015 Kumagai et al.
2015/0083451 A1 3/2015 Nishikawa
2015/0158155 A1 * 6/2015 Tsubakimoto ..... B25B 21/026 173/93
2016/0075004 A1 * 3/2016 Tsubakimoto ..... B25B 21/026 173/93
2016/0193726 A1 7/2016 Rompel et al.
2016/0250738 A1 9/2016 Leh et al.
2017/0036327 A1 2/2017 Murakami et al.
2017/0057062 A1 * 3/2017 Wang ..... B25B 21/026
2017/0239792 A1 8/2017 Yeoh et al.
2017/0259411 A1 * 9/2017 Ishibashi ..... B25B 21/026
2018/0272510 A1 * 9/2018 Muramatsu ..... B25B 21/02
2019/0375085 A1 * 12/2019 Chen ..... B25D 16/00
2020/0023501 A1 * 1/2020 Bandy ..... B25B 23/1475
2020/0276627 A1 * 9/2020 Chakravarti ..... B21C 33/004
2021/0086333 A1 * 3/2021 Murakami ..... B25B 21/02
2021/0094157 A1 * 4/2021 Chellew ..... B25B 21/02

FOREIGN PATENT DOCUMENTS

JP 2007030161 A 2/2007
JP 2007152448 A 6/2007
JP 2017094462 A * 6/2017
JP 2017094462 A 6/2017
KR 101453891 B1 * 11/2014 ..... B25B 23/14
WO 2014208058 A1 12/2014

OTHER PUBLICATIONS

International Search Report and Written Opinion for Application No. PCT/US2020/051166 dated Dec. 24, 2020 (10 pages).

* cited by examiner

TWO-PIECE HAMMER FOR IMPACT TOOL

TECHNICAL FIELD

The present invention relates to impact tools, and more particularly, to hammers for impact tools.

BACKGROUND

Impact tools or wrenches are typically utilized to provide a striking rotational force, or intermittent applications of torque, to a tool element or workpiece (e.g., a fastener) to either tighten or loosen the fastener. As such, impact wrenches are typically used to loosen or remove stuck fasteners (e.g., an automobile lug nut on an axle stud) that are otherwise not removable or very difficult to remove using hand tools.

SUMMARY OF THE INVENTION

In the first aspect, the present invention provides an impact tool including a housing, a motor supported within the housing, an anvil extending from the housing, and a drive assembly configured to convert a continuous rotational input from the motor to intermittent applications of torque to the anvil. The drive assembly includes a camshaft driven by the motor and a hammer configured to reciprocate along the camshaft. The hammer includes a core coupled to the camshaft and a sleeve coupled to the core.

In some embodiments, the core is made of a first material, and the sleeve is made of a second material different than the first material.

In some embodiments, the core is made of alloy steel and the sleeve is made of medium carbon steel.

In some embodiments, the hammer includes a hammer lug, the anvil includes an anvil lug, and the hammer lug is configured to strike the anvil lug to transmit torque to the anvil.

In some embodiments, the hammer lug is integrally formed with the core.

In some embodiments, the hammer lug is integrally formed with the sleeve.

In some embodiments, the sleeve is press fit on the core.

In some embodiments, the hammer includes a pin extending between the sleeve and the core to couple the sleeve for co-rotation with the core.

In some embodiments, one of the sleeve and the core includes a projection and the other of the sleeve and the core includes a recess configured to receive the projection to couple the sleeve for co-rotation with the core.

In some embodiments, the core includes an arcuate groove configured to receive a cam ball.

The present invention provides, in a second aspect, a hammer for delivering impacts to an anvil of an impact tool. The hammer includes a core having a surface hardness and an internal hardness less than the surface hardness, a sleeve coupled to the core, the sleeve having a generally uniform hardness that is at least 10% less than the surface hardness of the core and at least 10% greater than the internal hardness of the core, and a hammer lug integrally formed with one of the core or the sleeve. The hammer lug is configured to strike the anvil to transmit torque to the anvil.

In some embodiments, the sleeve is press fit on the core.

In some embodiments, a pin extends between the sleeve and the core to couple the sleeve for co-rotation with the core.

In some embodiments, one of the sleeve and the core includes a projection and the other of the sleeve and the core includes a recess configured to receive the projection to couple the sleeve for co-rotation with the core.

In some embodiments, the core is made of a low alloy nickel, chromium, and molybdenum case hardening steel, and the sleeve is made of a medium carbon steel.

The present invention provides, in a third aspect, a hammer for delivering impacts to an anvil of an impact tool. The hammer includes a core made of a first material, a sleeve coupled to the core, the sleeve made of a second material different than the first material, and a hammer lug integrally formed with one of the core or the sleeve. The hammer lug is configured to strike the anvil to transmit torque to the anvil.

In some embodiments, the sleeve includes a front end and a rear end opposite the front end, the core includes a front end and a rear end opposite the front end, the front end of the sleeve is flush with the front end of the core, and the rear end of the sleeve is offset from the rear end of the core.

In some embodiments, the core includes a first annular wall, the sleeve includes a second annular wall surrounding the first annular wall, and the second annular wall includes an internal shoulder abutting an axial end of the first annular wall.

In some embodiments, the first annular wall is engaged with the second annular wall in an interference fit.

In some embodiments, the first annular wall defines a recess configured to receive a portion of the anvil.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
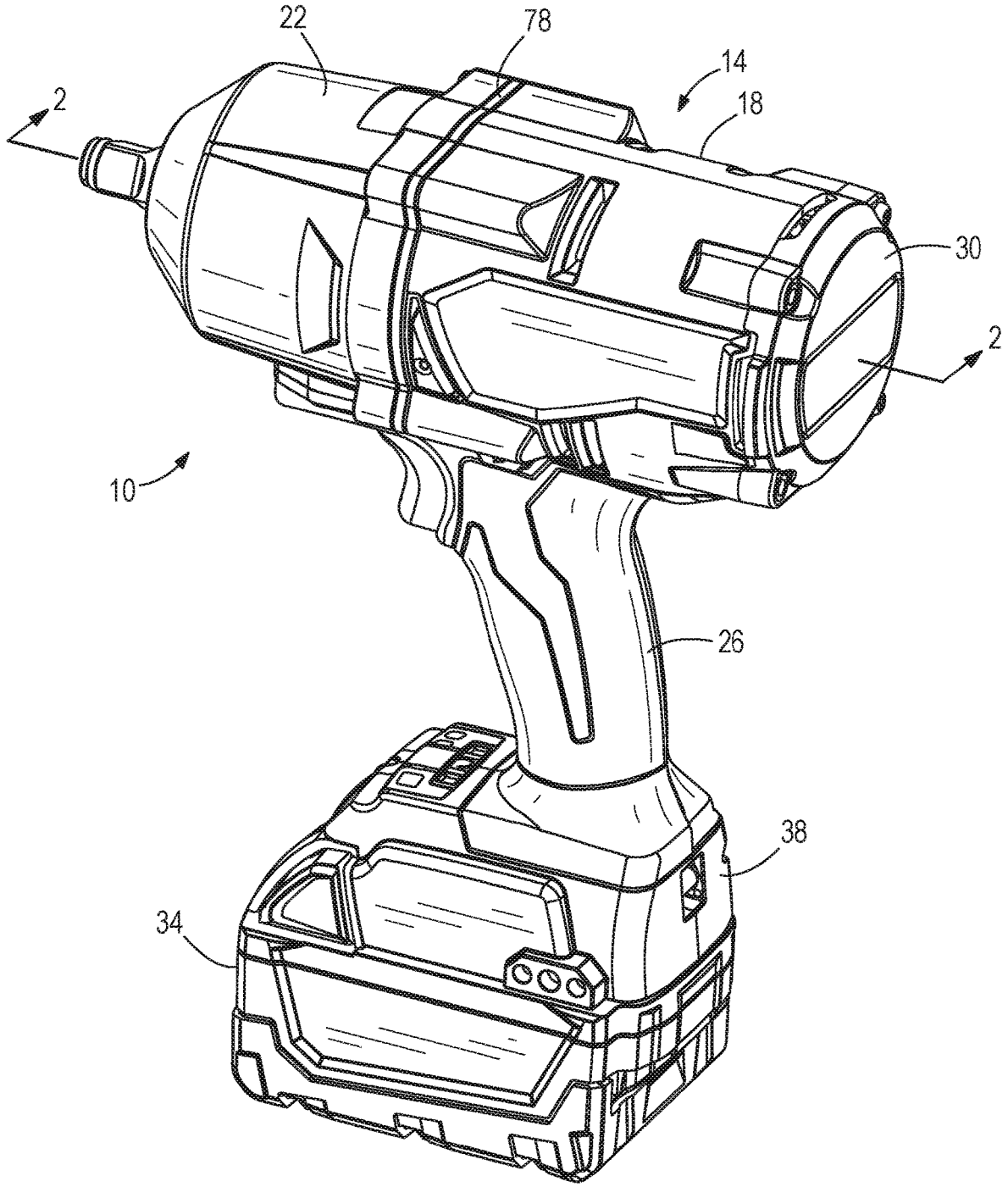
FIG. 1 is a perspective view of an impact tool according to an embodiment of the present invention.

FIG. 1 illustrates an impact tool 10 in the form of an impact wrench. The impact wrench 10 includes a housing 14 with a motor housing portion 18, a front housing portion 22 coupled to the motor housing portion 18 (e.g., by a plurality of fasteners), and a handle portion 26 extending downward from the motor housing portion 18. In the illustrated embodiment, the handle portion 26 and the motor housing portion 18 are defined by cooperating clamshell halves. The illustrated housing 14 also includes an end cap 30 coupled to the motor housing portion 18 opposite the front housing portion 22.

Figure 2:
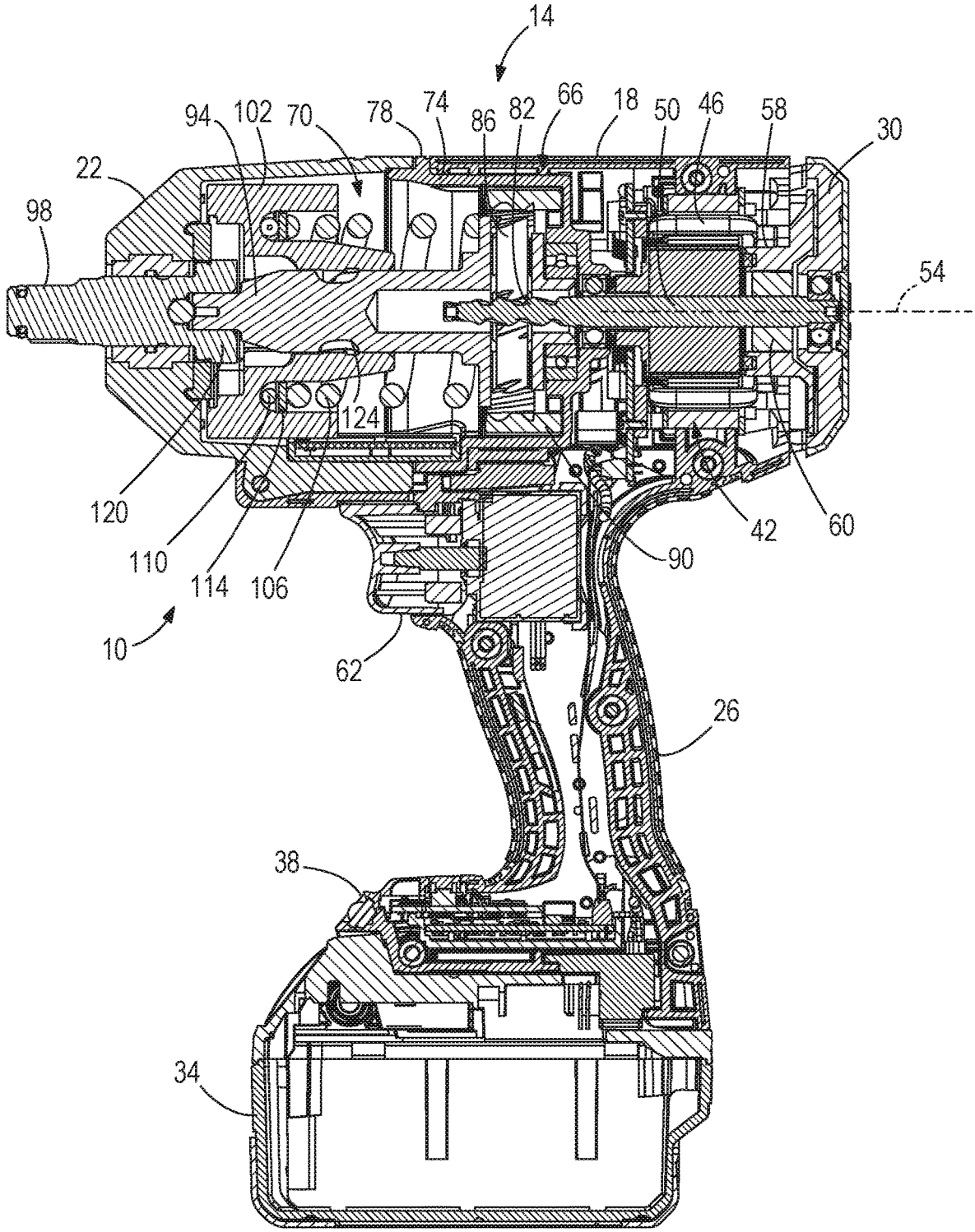
FIG. 2 is a cross-sectional view of the impact tool of FIG. 1, taken along line 2-2 in FIG. 1.

Referring to FIGS. 1 and 2, the impact wrench 10 has a battery 34 removably coupled to a battery receptacle 38 located at a bottom end of the handle portion 26. An electric motor 42, supported within the motor housing portion 18, receives power from the battery 34 via the battery receptacle 38 when the battery 34 is coupled to the battery receptacle 38. In the illustrated embodiment, the motor 42 is a brushless direct current ("BLDC") motor with a stator 46 and an output shaft or rotor 50 that is rotatable about an axis 54 relative to the stator 46. In other embodiments, other types of motors may be used. A fan 58 is coupled to the output shaft 50 (e.g., via a splined member 60 fixed to the output shaft 50) behind the motor 42.

The impact wrench 10 also includes a switch (e.g., trigger switch 62) supported by the housing 14 that selectively electrically connects the motor 42 and the battery 34 to provide DC power to the motor 42. In other embodiments, the impact wrench 10 may include a power cord for electrically connecting the switch 62 and the motor 42 to a source of AC power. As a further alternative, the impact wrench 10 may be configured to operate using a different power source (e.g., a pneumatic or hydraulic power source, etc.).

Referring to FIG. 2, the impact wrench 10 further includes a gear assembly 66 coupled to the motor output shaft 50 and a drive assembly 70 coupled to an output of the gear assembly 66. The gear assembly 66 may be configured in any of a number of different ways to provide a speed reduction between the output shaft 50 and an input of the drive assembly 70. The gear assembly 66 is at least partially housed within a gear case 74 fixed to the housing 14. In the illustrated embodiment, the gear case 74 includes an outer flange 78 that is sandwiched between the front housing portion 22 and the motor housing portion 18. The fasteners that secure the front housing portion 22 to the motor housing portion 18 also pass through the outer flange 78 of the gear case 74 to fix the gear case 74 relative to the housing 14.

The gear assembly 66 includes a pinion 82 formed on the motor output shaft 50, a plurality of planet gears 86 meshed with the pinion 82, and a ring gear 90 meshed with the planet gears 86 and rotationally fixed within the gear case 74. The planet gears 86 are mounted on a camshaft 94 of the drive assembly 70 such that the camshaft 94 acts as a planet carrier. Accordingly, rotation of the output shaft 50 rotates the planet gears 86, which then advance along the inner circumference of the ring gear 90 and thereby rotate the camshaft 94.

The drive assembly 70 includes an anvil 98, extending from the front housing portion 22, to which a tool element (not shown) can be coupled for performing work on a workpiece (e.g., a fastener). The drive assembly 70 is configured to convert the constant rotational force or torque provided by motor 42 via the gear assembly 66 to a striking rotational force or intermittent applications of torque to the anvil 98 when the reaction torque on the anvil 98 (e.g., due to engagement between the tool element and a fastener being worked upon) exceeds a certain threshold. In the illustrated embodiment of the impact wrench 10, the drive assembly 66 includes the camshaft 94, a hammer 102 supported on and axially slidable relative to the camshaft 94, and the anvil 98.

With continued reference to FIG. 2, the drive assembly 70 further includes a spring 106 biasing the hammer 102 toward the front of the impact wrench 10 (i.e., in the left direction of FIG. 2). In other words, the spring 106 biases the hammer 102 in an axial direction toward the anvil 98, along the axis 54. A thrust bearing 110 and a thrust washer 114 are positioned between the spring 106 and the hammer 102. The thrust bearing 110 and the thrust washer 114 allow for the spring 106 and the camshaft 94 to continue to rotate relative to the hammer 102 after each impact strike when lugs (not shown) on the hammer 102 engage with corresponding anvil lugs 120 and rotation of the hammer 102 momentarily stops. The camshaft 94 further includes cam grooves 124 in which corresponding cam balls (not shown) are received. The cam balls are in driving engagement with the hammer 102 and movement of the cam balls within the cam grooves 124 allows for relative axial movement of the hammer 102 along the camshaft 94 when the hammer lugs and the anvil lugs 120 are engaged and the camshaft 94 continues to rotate.

In operation of the impact wrench 10, an operator depresses the switch 62 to activate the motor 42, which continuously drives the gear assembly 66 and the camshaft 94 via the output shaft 50. As the camshaft 94 rotates, the cam balls drive the hammer 102 to co-rotate with the camshaft 94, and the drive surfaces of hammer lugs engage, respectively, the driven surfaces of the anvil lugs 120 to provide an impact and to rotatably drive the anvil 98 and the tool element. After each impact, the hammer 102 moves or slides rearward along the camshaft 94, away from the anvil 98, so that the hammer lugs disengage the anvil lugs 120. As the hammer 102 moves rearward, the cam balls situated in the respective cam grooves 124 in the camshaft 94 move rearward in the cam grooves 124. The spring 106 stores some of the rearward energy of the hammer 102 to provide a return mechanism for the hammer 102. After the hammer lugs disengage the respective anvil lugs 120, the hammer 102 continues to rotate and moves or slides forwardly, toward the anvil 98, as the spring 106 releases its stored energy, until the drive surfaces of the hammer lugs re-engage the driven surfaces of the anvil lugs 120 to cause another impact.

Figure 3:
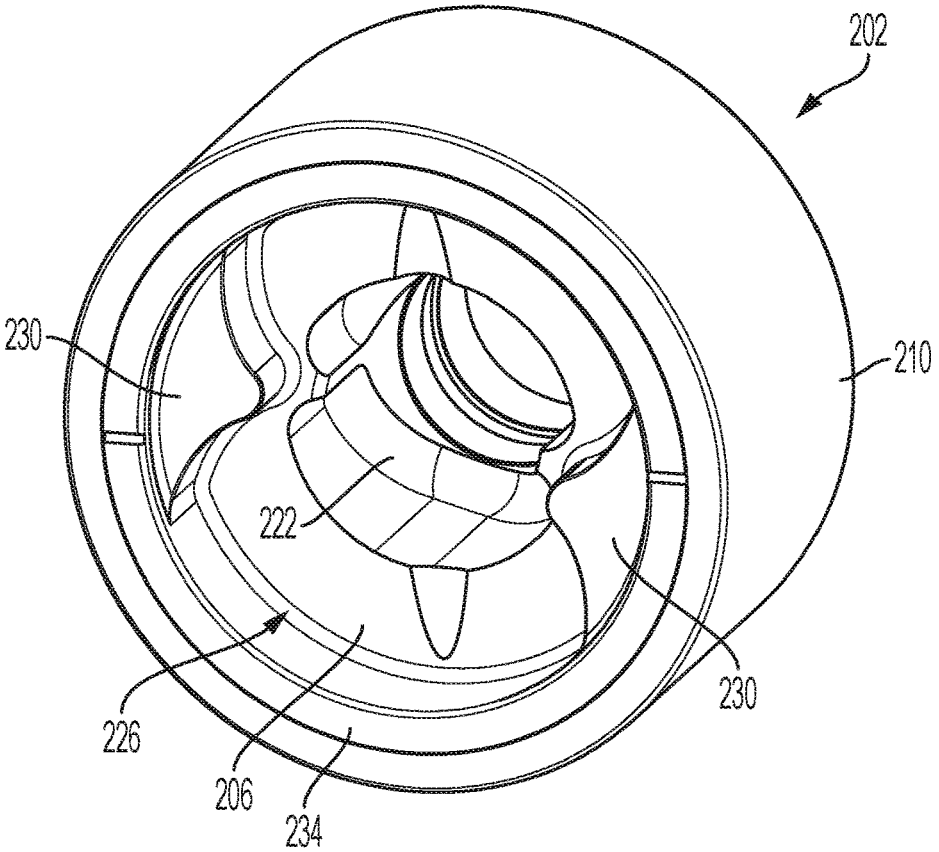
FIG. 3 is a perspective view of a hammer according to a first embodiment of the present invention that is usable with the impact tool of FIG. 1.
Figure 4:
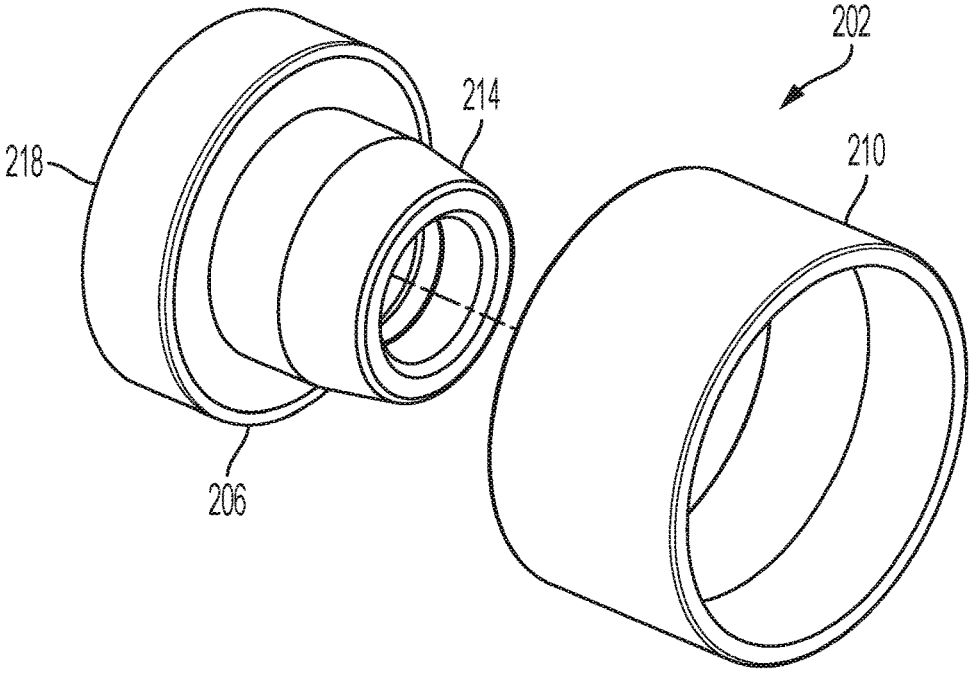
FIG. 4 is an exploded view of the hammer of FIG. 3.
Figure 5:
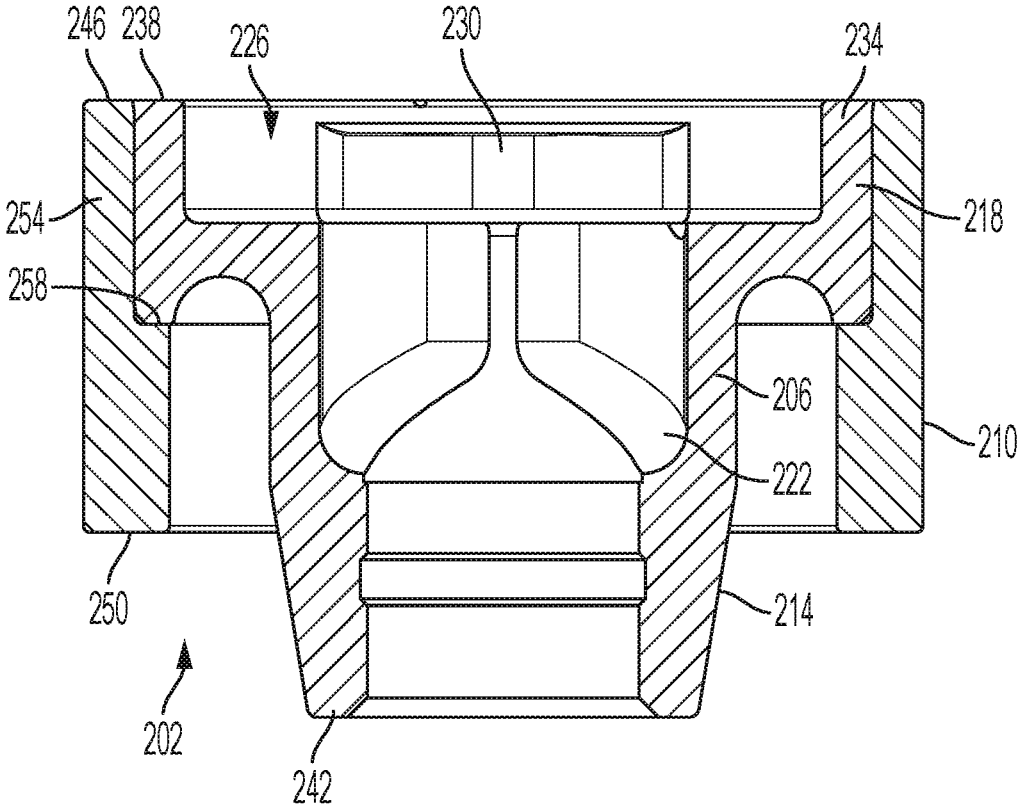
FIG. 5 is a cross-sectional view of the hammer of FIG. 3.

FIGS. 3-5 illustrate a hammer 202 according to another embodiment. The hammer 202 may be incorporated into the drive assembly 70 of the impact wrench 10 described above with reference to FIGS. 1 and 2.

The illustrated hammer 202 includes a core 206 and a sleeve 210 surrounding the core 206 and coupled for co-rotation with the core 206. Referring to FIG. 5, the core 206 includes a drive portion 214 and an impact portion 218. The drive portion 214 includes arcuate grooves 222 configured to receive cam balls (not shown) to drivably couple the hammer 202 to the camshaft 94. The impact portion 218 extends axially from the drive portion 214 and includes a recess 226 configured to receive a portion of the anvil 98. A plurality of hammer lugs 230 extends radially inwardly from an annular wall 234 that forms the outer periphery of the recess 226 (FIG. 3). The hammer lugs 230 are integrally formed with the core 206. In the illustrated embodiment, the hammer 202 includes two hammer lugs 230, but the hammer 202 may include a single hammer lug 230 or three hammer lugs 230 in other embodiments. The hammer lugs 230 are engageable with the anvil lugs 120 (FIG. 2) to impart torque in the form of rotational impacts to the anvil 98.

Referring to FIG. 5, the impact portion 218 defines a front end 238 of the core 206, and the drive portion 214 defines a rear end 242 of the core 206 opposite the front end 238. The sleeve 210 includes a front end 246 that is flush with the front end 238 of the core 206. In the illustrated embodiment, the sleeve 210 is shorter in length in the axial direction than the core 206, such that a rear end 250 of the sleeve 210 is offset from the rear end 242 of the core 206. In other embodiments, the sleeve 210 may extend the entire length of the core 206, or the rear end 250 of the sleeve 210 may extend beyond the rear end 242 of the core 206.

The sleeve 210 includes an annular wall 254 that circumferentially surrounds and engages the annular wall 234 of the impact portion 218. In the illustrated embodiment, the sleeve 210 also includes an internal shoulder 258 that engages a rear side of the annular wall 234. During assembly of the hammer 202, the sleeve 210 is pressed onto the core 206 until the shoulder 258 abuts the rear side of the annular wall 234. The engagement between the annular wall 254 of the sleeve 210 and the annular wall 234 of the impact portion 218 (i.e., by an interference fit) couples the core 206 and sleeve 210 together for co-rotation. In other embodiments, the sleeve 210 and the core 206 may be coupled together in other ways (e.g., a key and keyway arrangement, connecting pins or fasteners, or the like).

The core 206 is forged and hardened to provide impact toughness. In some embodiments, the core 206 is forged from a low alloy nickel, chromium, and molybdenum case hardening steel, such as SAE 8620 alloy steel. In other embodiments, other alloy steels or other suitably tough and hardenable metals may be used. In some embodiments, after forging, the core 206 is carburized, quenched, and tempered to provide a surface hardness between 57 and 65 HRC, and an internal hardness between 35 and 38 HRC. In other embodiments, the core 206 may be treated with other hardening processes, such as nitriding. The high surface hardness and relatively lower internal hardness of the core 206 provides the core 206 with the toughness necessary to withstand repeated impacts.

Because it is a separate part, the outer sleeve 210 can be made using different materials and processes than the core 206, which advantageously reduces the complexity and cost of manufacturing the hammer 202. In some embodiments, the outer sleeve 210 is made of medium carbon steel, such as ASTM 1045 medium carbon steel having a carbon content of about 0.45%. In some embodiments, the sleeve 210 is heat treated via a tempering process to a hardness between 48 and 52 HRC, and the sleeve 210 may have a generally uniform hardness. Thus, in some embodiments, the sleeve 210 has a hardness measured under the Rockwell C scale that is greater than the internal hardness of the core 206 but less than the surface hardness of the core 206. In some embodiments, the hardness of the sleeve 210 is at least 10% greater than the internal hardness of the core 206 and at least 10% less than the surface hardness of the core 206. The sleeve 210 advantageously adds weight to the hammer 202, which increases the impact energy delivered to the anvil 98. Because the impacts are applied to the anvil 98 via the hammer lugs 230 on the core 206, however, the sleeve 210 need not have the same impact toughness as the core 206.

Figure 6:
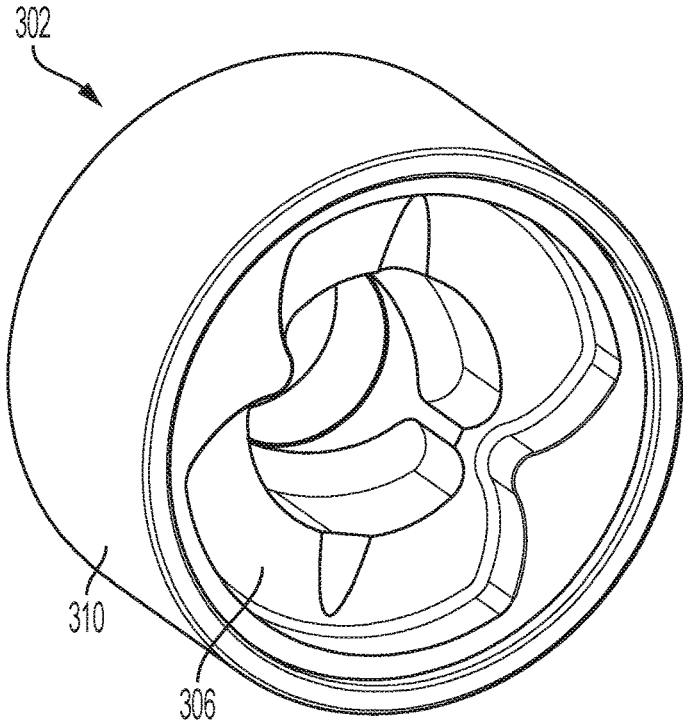
FIG. 6 is a perspective view of a hammer according to a second embodiment of the present invention that is usable with the impact tool of FIG. 1.
Figure 7:
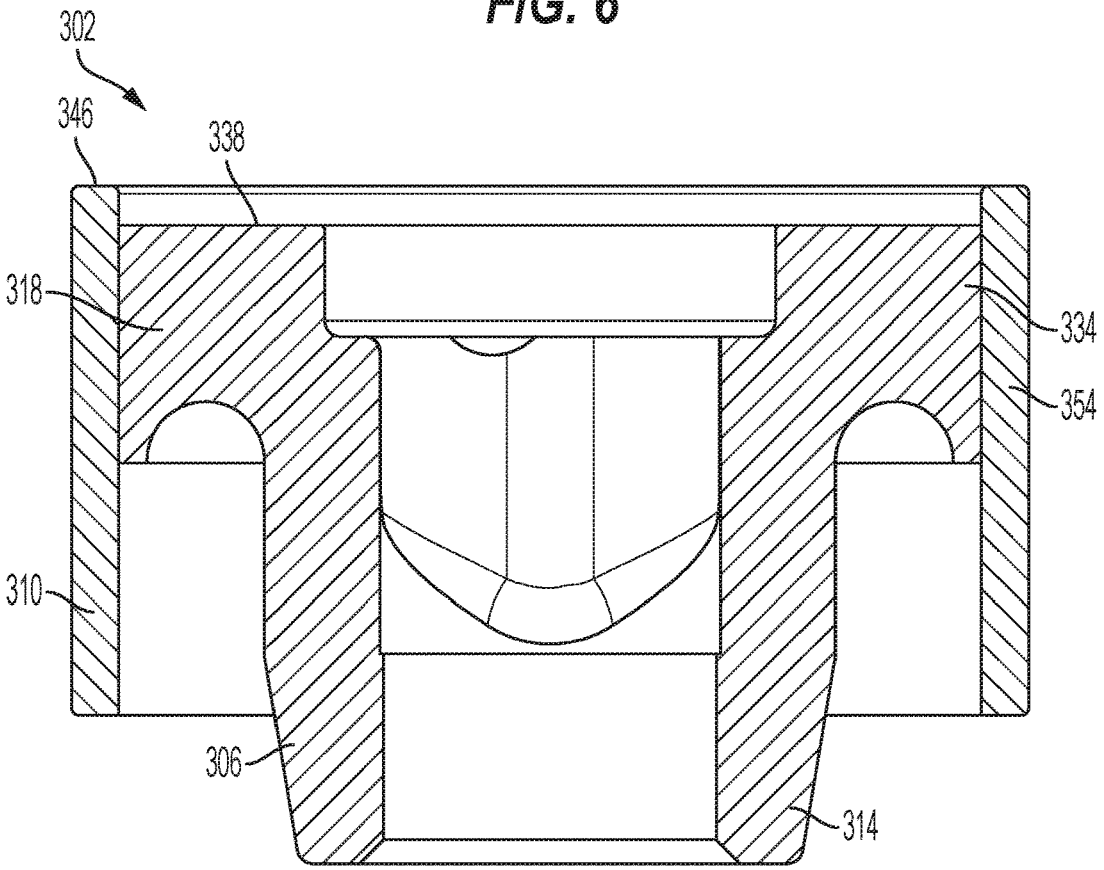
FIG. 7 is a cross-sectional view of the hammer of FIG. 6.

FIGS. 6 and 7 illustrate a hammer 302 according to another embodiment. The hammer 302 may be incorporated into the drive assembly 70 of the impact wrench 10 described above with reference to FIGS. 1 and 2. The hammer 302 is similar to the hammer 202 described above with reference to FIGS. 3-5, and features and elements of the hammer 302 corresponding with features and elements of the hammer 202 are given like reference numbers plus 100. In addition, the following description focuses primarily on differences between the hammer 302 and the hammer 202.

The illustrated hammer 302 includes a core 306 and a sleeve 310 surrounding the core 306 and coupled for co-rotation with the core 306. Referring to FIG. 7, the core 306 includes a drive portion 314 and an impact portion 318. The impact portion 318 defines a front end 338 of the core 306. The sleeve 310 includes a front end 346 that projects beyond the front end 338 of the core 306 and an annular wall 354 that circumferentially surrounds and engages an annular wall 334 of the impact portion 318. In other embodiments, the sleeve 310 and the core 306 may be positioned such that the front ends 346, 338 are flush. The sleeve 310 does not include an internal shoulder, but rather has a cylindrical inner surface with a constant diameter along the entire length of the sleeve 310. As such, the sleeve 310 may be simpler and/or less costly to manufacture than the sleeve 210 described above.

During assembly of the hammer 302, the sleeve 310 is pressed onto the core 306 until the front end 346 of the sleeve 310 projects a specified distance beyond the front end 338 of the core 306. The engagement between the annular wall 354 of the sleeve 310 and the annular wall 334 of the impact portion 318 (i.e., by an interference fit) couples the core 306 and sleeve 310 together for co-rotation. Because it is a separate part, the outer sleeve 310 can be made using different materials and processes than the core 306, which advantageously reduces the complexity and cost of manufacturing the hammer 302.

Figure 8:
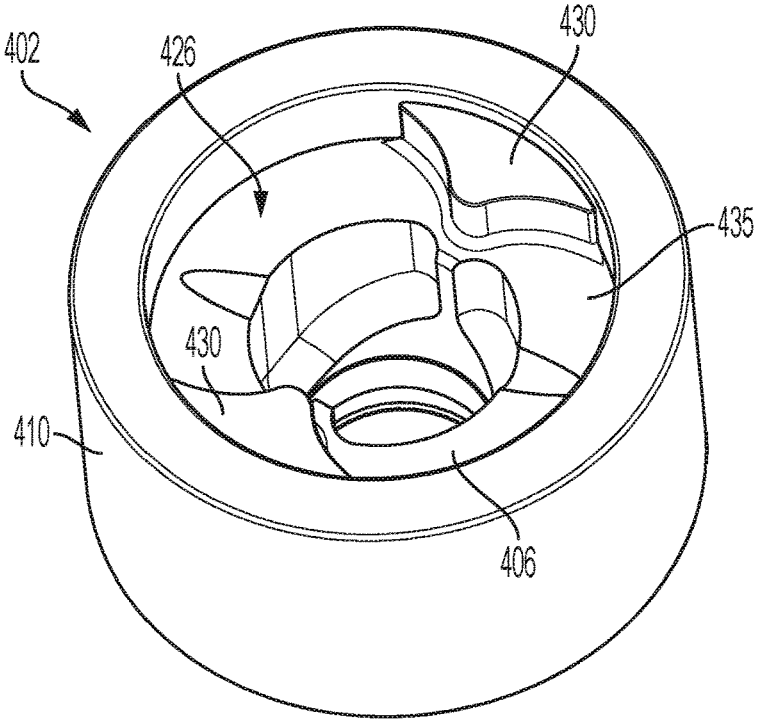
FIG. 8 is a perspective view of a hammer according to a third embodiment of the present invention that is usable with the impact tool of FIG. 1.
Figure 9:
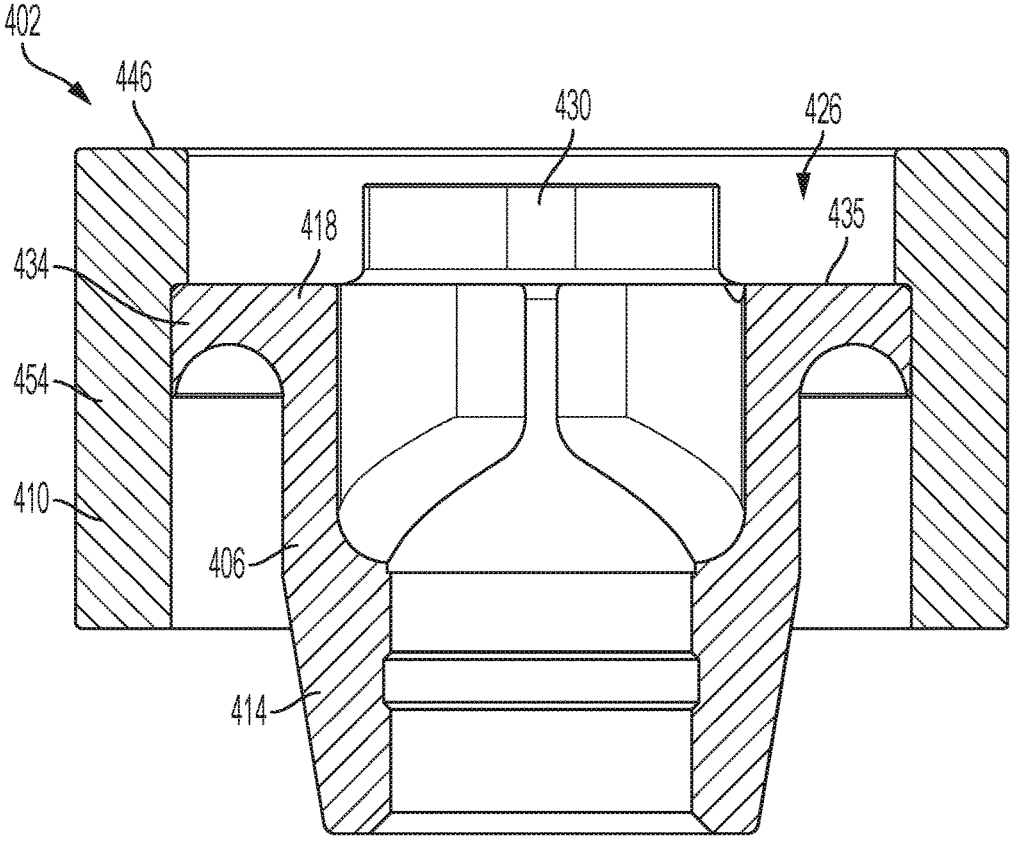
FIG. 9 is a cross-sectional view of the hammer of FIG. 8.

FIGS. 8 and 9 illustrate a hammer 402 according to another embodiment. The hammer 402 may be incorporated into the drive assembly 70 of the impact wrench 10 described above with reference to FIGS. 1 and 2. The hammer 402 is similar to the hammer 202 described above with reference to FIGS. 3-5, and features and elements of the hammer 402 corresponding with features and elements of the hammer 202 are given like reference numbers plus 200. In addition, the following description focuses primarily on differences between the hammer 402 and the hammer 202.

The illustrated hammer 402 includes a core 406 and a sleeve 410 surrounding the core 406 and coupled for co-rotation with the core 406. The core 406 includes a drive portion 414 and an impact portion 418 (FIG. 9). The impact portion 418 includes an annular wall 434 that is surrounded by and engaged with an annular wall 454 of the sleeve 410. The impact portion 418 also includes a plurality of hammer lugs 430 that extend forward from a front side 435 of the annular wall 434. The sleeve 410 includes a front end 446 that projects beyond the front side 435 such that the sleeve 410 defines a recess 426 containing the hammer lugs 430.

Accordingly, the core 406 of the hammer 402 includes a shorter annular wall 434 than the annular wall 234 of the core 206 described above and therefore uses less material.

Because the material of the core 406 may be more expensive than the material of the sleeve 410, minimizing the amount of material used for the core 406 may advantageously reduce the cost of the hammer 402.

Figure 10:
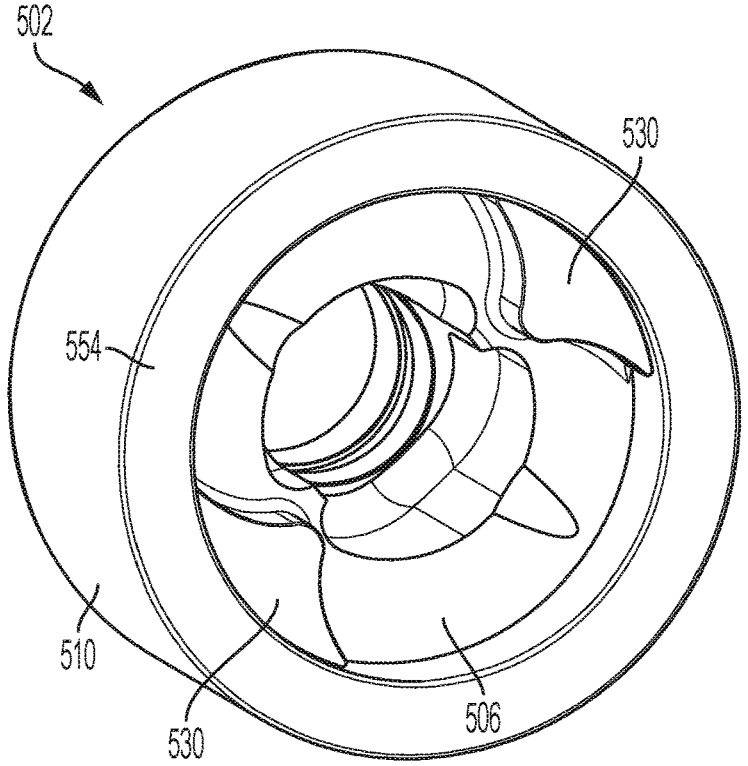
FIG. 10 is a perspective view of a hammer according to a fourth embodiment of the present invention that is usable with the impact tool of FIG. 1.
Figure 11:
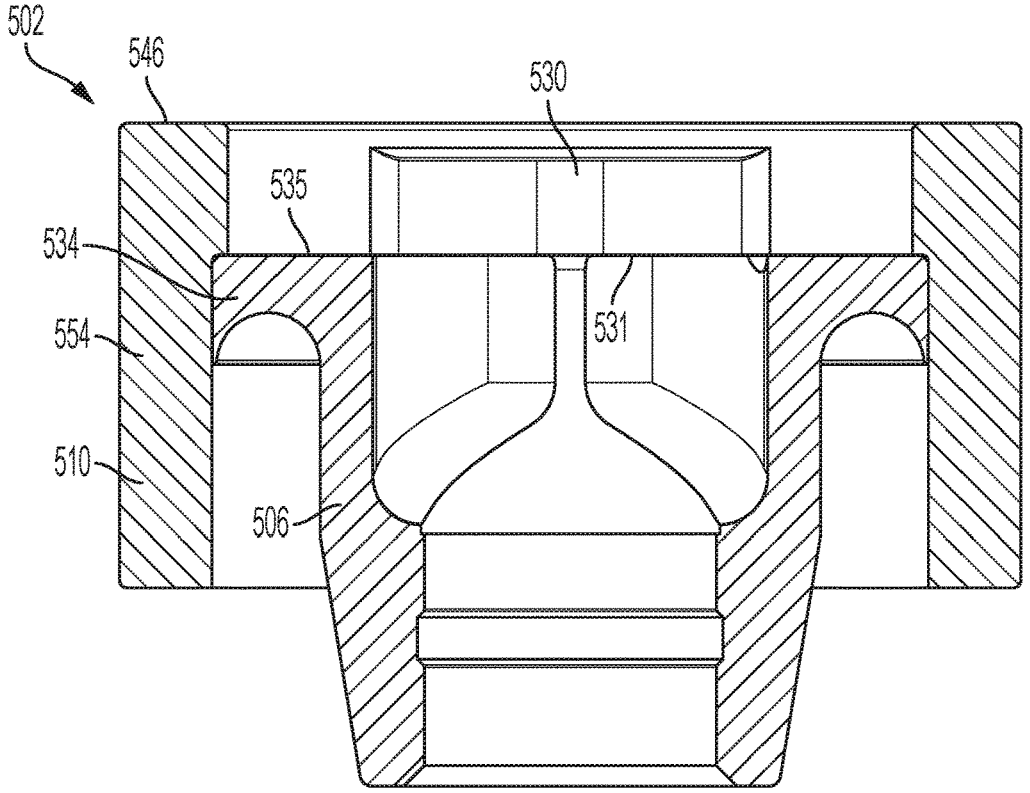
FIG. 11 is a cross-sectional view of the hammer of FIG. 10.

FIGS. 10 and 11 illustrate a hammer 502 according to another embodiment. The hammer 502 may be incorporated into the drive assembly 70 of the impact wrench 10 described above with reference to FIGS. 1 and 2. The hammer 502 is similar to the hammer 402 described above with reference to FIGS. 8 and 9, and features and elements of the hammer 502 corresponding with features and elements of the hammer 402 are given like reference numbers plus 100. In addition, the following description focuses primarily on differences between the hammer 502 and the hammer 402.

The illustrated hammer 502 includes a core 506 and a sleeve 510 surrounding the core 506 and coupled for co-rotation with the core 506. The core 506 includes an annular wall 534 that is surrounded by and engaged with an annular wall 554 of the sleeve 510. The sleeve 510 includes a plurality of hammer lugs 530 that extend radially inward from the inner periphery of the annular wall 554. The back side 531 of each lug 530 is positioned to abut a front side 535 of the annular wall 534. By including the hammer lugs 530 as part of the sleeve 510 rather than the core 506, the amount of material used for the core 506 is minimized.

Figure 12:
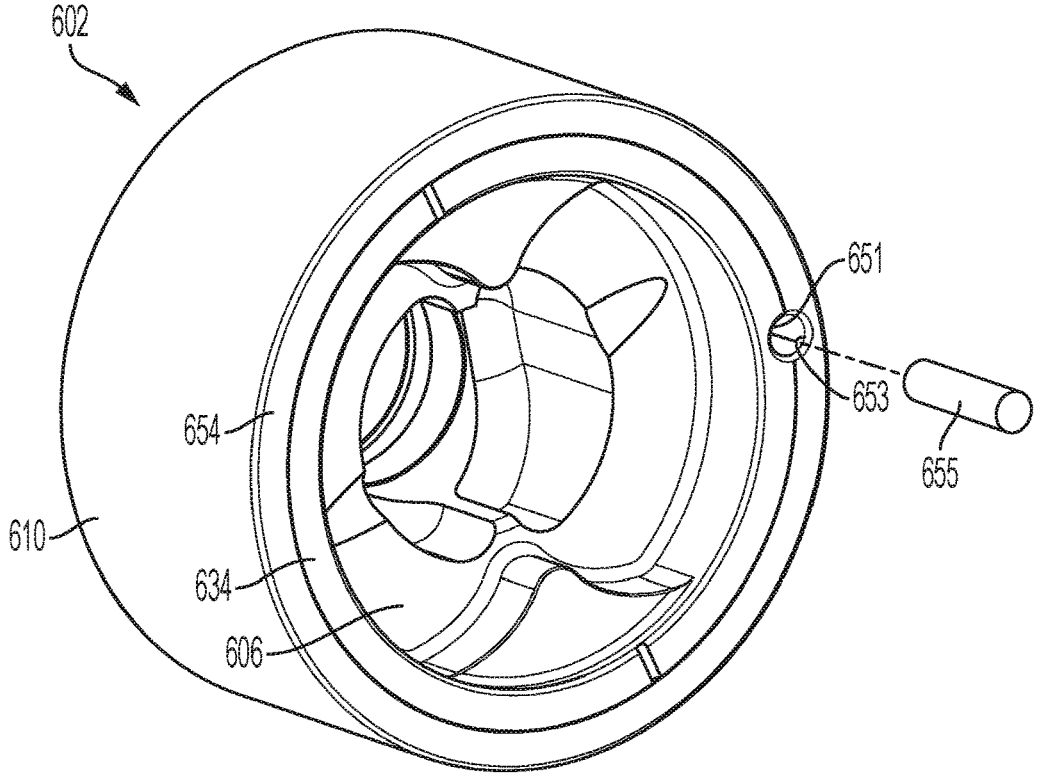
FIG. 12 is a perspective view of a hammer according to a fifth embodiment of the present invention that is usable with the impact tool of FIG. 1.
Figure 13:
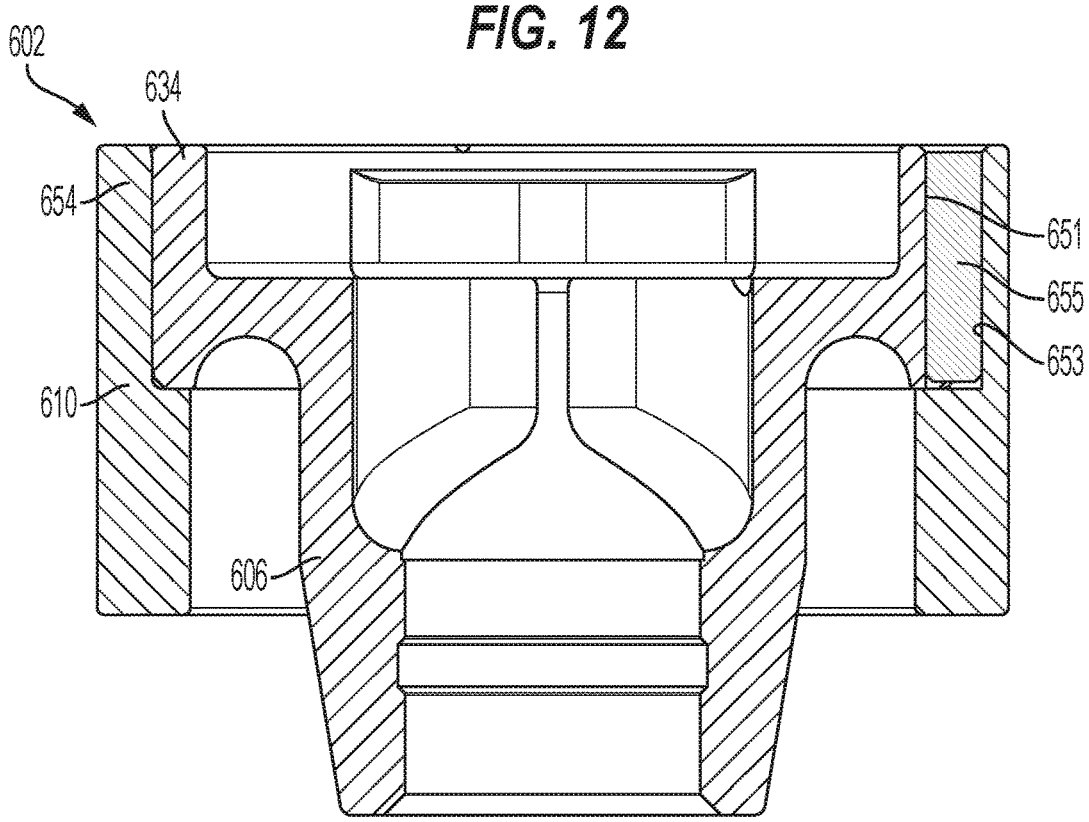
FIG. 13 is a cross-sectional view of the hammer of FIG. 12.

FIGS. 12 and 13 illustrate a hammer 602 according to another embodiment. The hammer 602 may be incorporated into the drive assembly 70 of the impact wrench 10 described above with reference to FIGS. 1 and 2. The hammer 602 is similar to the hammer 202 described above with reference to FIGS. 3-5, and features and elements of the hammer 302 corresponding with features and elements of the hammer 202 are given like reference numbers plus 400. In addition, the following description focuses primarily on differences between the hammer 602 and the hammer 202.

The illustrated hammer 602 includes a core 606 and a sleeve 610 surrounding the core 606 and coupled for co-rotation with the core 606. The sleeve 610 includes an annular wall 654 that circumferentially surrounds and engages an annular wall 634 of the core 606. An exterior side of the annular wall 634 includes a first arcuate recess 651, and an interior side of the annular wall 654 includes a second arcuate recess 653 opposite the first arcuate recess 651. The recesses 651, 653 cooperate to define an axially-extending opening in the front end of the hammer 602. A pin 655 is received within the recesses 651, 653. The pin 655 couples the core 606 and the sleeve 610 together for co-rotation and may transfer torque between the core 606 and the sleeve 610. In some embodiments, the pin 655 may be in threaded engagement with the recesses 651, 653. In other embodiments, the pin 655 may be press-fit between the recesses 651, 653. Although the illustrated pin 655 is cylindrical, the pin 655 and the recesses 651, 653 may have other cooperating shapes. In addition, the hammer 602 may include multiple pins 655 in other embodiments.

Figure 14:
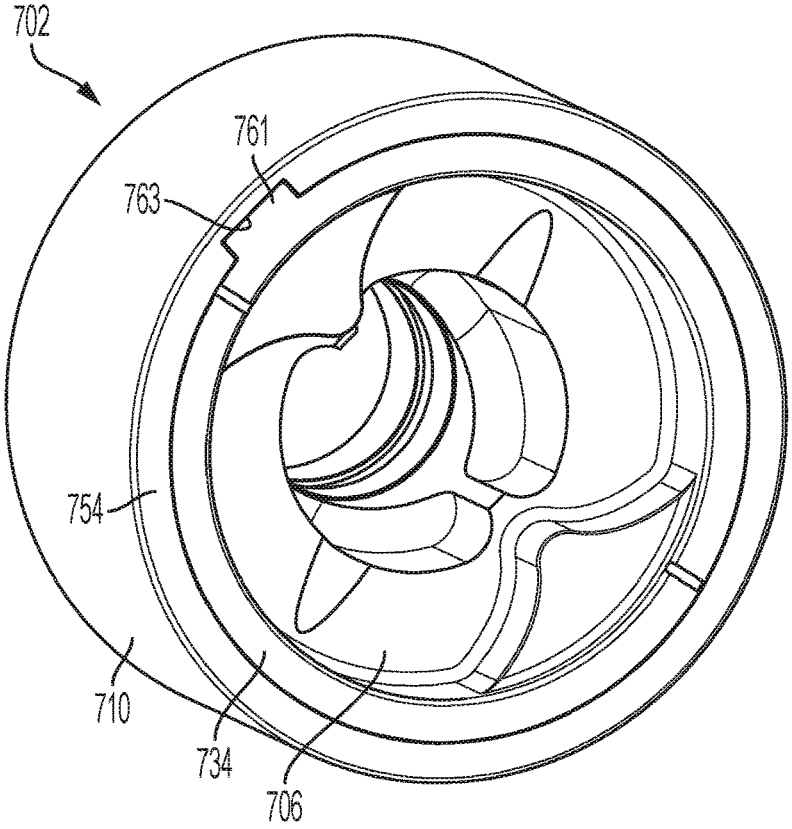
FIG. 14 is a perspective view of a hammer according to a sixth embodiment of the present invention that is usable with the impact tool of FIG. 1.
Figure 15:
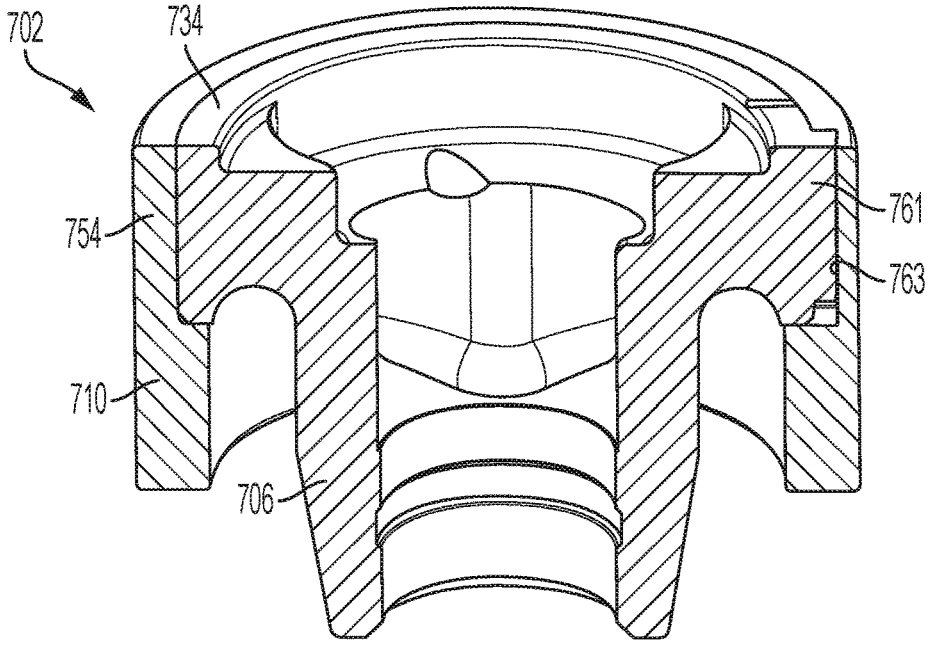
FIG. 15 is a cross-sectional view of the hammer of FIG. 14.

FIGS. 14 and 15 illustrate a hammer 702 according to another embodiment. The hammer 702 may be incorporated into the drive assembly 70 of the impact wrench 10 described above with reference to FIGS. 1 and 2. The hammer 702 is similar to the hammer 602 described above with reference to FIGS. 12 and 13, and features and elements of the hammer 702 corresponding with features and elements of the hammer 602 are given like reference numbers plus 100. In addition, the following description focuses primarily on differences between the hammer 702 and the hammer 602.

The illustrated hammer 702 includes a core 706 and a sleeve 710 surrounding the core 706 and coupled for co-rotation with the core 706. The sleeve 710 includes an annular wall 754 that circumferentially surrounds and engages an annular wall 734 of the core 706. An exterior side of the annular wall 734 includes a radial projection 761 (i.e., a key), and an interior side of the annular wall 754 includes a recess 763 (i.e., a keyway) the receives the radial projection 761. The engagement between the projection 761 and the recess 763 couples the core 706 and the sleeve 710 together for co-rotation and may transfer torque between the core 706 and the sleeve 710. Although the illustrated projection 761 and recess 763 are generally rectangular, projection 761 and recess 763 may have other cooperating shapes. In addition, the hammer 702 may include multiple projections 761 and recesses 763 in other embodiments. The projection 761 may also be formed on the sleeve 710, and the recess 763 may be formed in the core 706.

Various features of the invention are set forth in the claims.

The invention claimed is:

1. An impact tool comprising:

a housing;

a motor supported within the housing;

an anvil extending from the housing; and a drive assembly configured to convert a continuous rotational input from the motor to intermittent applications of torque to the anvil, the drive assembly including a camshaft driven by the motor and a hammer configured to reciprocate along the camshaft and deliver impacts to the anvil, wherein the hammer includes a core and a sleeve fixed to the core such that the sleeve and the core are configured to reciprocate together along the camshaft, and wherein the core and the sleeve are formed as separate parts with the core inserted into the sleeve.

2. The impact tool of claim 1, wherein the core is made of a first material, and the sleeve is made of a second material different than the first material.

3. The impact tool of claim 2, wherein the core is made of alloy steel and the sleeve is made of medium carbon steel.

4. The impact tool of claim 2, wherein the core is made of a low alloy nickel, chromium, and molybdenum case hardening steel, and wherein the sleeve is made of a medium carbon steel.

5. The impact tool of claim 1, wherein the hammer includes a hammer lug, wherein the anvil includes an anvil lug, and wherein the hammer lug is configured to strike the anvil lug to transmit torque to the anvil.

6. The impact tool of claim 5, wherein the hammer lug is integrally formed with the core.

7. The impact tool of claim 5, wherein the hammer lug is integrally formed with the sleeve.

8. The impact tool of claim 1, wherein the sleeve is press fit on the core.

9. The impact tool of claim 1, wherein the hammer includes a pin extending between the sleeve and the core to couple the sleeve for co-rotation with the core.

10. The impact tool of claim 1, wherein one of the sleeve and the core includes a projection and the other of the sleeve and the core includes a recess configured to receive the projection to couple the sleeve for co-rotation with the core.

11. The impact tool of claim 1, wherein the core includes an arcuate groove.

12. The impact tool of claim 1, wherein the core has a surface hardness and an internal hardness less than the surface hardness.

13. The impact tool of claim 12, wherein the sleeve has a generally uniform hardness that is at least 10% less than the surface hardness of the core and at least 10% greater than the internal hardness of the core.

14. The impact tool of claim 13, wherein the hammer includes a hammer lug integrally formed with one of the core or the sleeve, and wherein the hammer lug is configured to strike the anvil to transmit torque to the anvil.

15. The impact tool of claim 1, wherein the sleeve includes a front end and a rear end opposite the front end, wherein the core includes a front end and a rear end opposite the front end, and wherein the front end of the sleeve is flush with the front end of the core.

16. The impact tool of claim 15, wherein the rear end of the sleeve is offset from the rear end of the core.

17. The impact tool of claim 1, wherein the core includes a first annular wall, wherein the sleeve includes a second annular wall surrounding the first annular wall, and wherein the second annular wall includes an internal shoulder abutting an axial end of the first annular wall.

18. The impact tool of claim 17, wherein the first annular wall is engaged with the second annular wall in an interference fit.

19. The impact tool of claim 17, wherein the first annular wall defines a recess configured to receive a portion of the anvil.

* * * * *